United States Patent [19]

Sparlin

[11] 4,027,730

[45] June 7, 1977

[54] SEAL ASSEMBLY FOR FLUID INJECTION PUMP-DOWN TOOLS

[75] Inventor: Derry D. Sparlin, Ponca City, Okla.

[73] Assignee: Continental Oil Company, Ponca City, Okla.

[22] Filed: June 28, 1976

[21] Appl. No.: 700,696

[52] U.S. Cl. ..... 166/156
[51] Int. Cl.[2] ..... E21B 33/16
[58] Field of Search ..... 166/153, 155, 156

[56] References Cited

UNITED STATES PATENTS

| | | | |
|---|---|---|---|
| 3,020,955 | 2/1962 | Tausch | 166/156 |
| 3,104,714 | 9/1963 | Terrel et al. | 166/155 |
| 3,117,627 | 1/1964 | Jarboe, Jr. et al | 166/155 |
| 3,361,206 | 1/1968 | Raulins | 166/156 |
| 3,464,495 | 9/1969 | Childers et al. | 166/155 |
| 3,464,496 | 9/1969 | Genois et al. | 166/153 |

*Primary Examiner*—James A. Leppink

*Attorney, Agent, or Firm*—A. Joe Reinert; F. Lindsey Scott

[57] ABSTRACT

In pump-down tools for use in well maintenance operations wherein fluids are injected into a well and wherein the tool includes a tubular member having locomotives positioned thereabout and a fluid passageway positioned therethrough and is connected to a fluid injection member positioned in fluid communication with the fluid passageway and the well; the well being equipped with a first tubing member and a second tubing member which are in fluid communication near their lower ends so that the tool is readily moved through the first tubing member by pumping fluid sequentially through the first tubing member, the junction between the first and second tubing member and the second tubing member and is moved in the opposite direction by reverse circulation, an improvement comprising positioning on the tubular member above the locomotives a sealing ring which is releasably maintained in position at a suitable angle from the axis of the tubular member.

5 Claims, 3 Drawing Figures

SEAL ASSEMBLY FOR FLUID INJECTION PUMP-DOWN TOOLS

FIELD OF THE INVENTION

This invention relates to pump-down tools for use in the injection and/or circulation of fluids in wells and the like.

The invention further relates to a method for sealing the annulus between a fluid injection tool and a tubing member to increase the fluid velocity through the fluid injection tool.

BRIEF DESCRIPTION OF PRIOR ART

In recent years the use of offshore platforms has increased dramatically in the oil industry. As is well known to those skilled in the art many offshore wells are located remotely from the servicing platform at locations on the ocean floor so that wells located over a greater area may be serviced from a single platform. The maintenance of such remotely located wells has posed problems and one solution has been the use of pump-down tools for operations such as paraffin-scraping, sand washing and the like. In the use of such tools the well is fitted with two tubing members which extend to a lower portion of the well. They are joined near their lower ends by a junction (H-member) whereby fluid communication between a first and second tubing member is achieved. The pump-down tool comprising a tubular member and locomotives positioned thereabout when placed in the first tubular member is readily moved along the first tubular member by pumping fluid down the first tubular member, through the junction between the first and second tubular members and back up the second tubular member. A variety of techniques for positioning the pump-down tool at a desired location in the first tubing member and the like are known to those skilled in the art and some such techniques are shown in SPE preprint No. 2246, "Advancements in Remote Completion and Operation of Underwater Satellite Wells," Childers and Longely, Fall Meeting, 1968 and a brochure No. OEC 5113 published by the Otis Engineering Company of Dallas, Tex. entitled, "Pump-Down Completion Equipment". In the use of such tools for sand washing, flushing and the like, the tool is normally passed along the first tubing member to a position near the junction commonly known as an H-member and is then retained in position by a no-go device which is positioned in the first tubular member and adapted to mate with the pump-down tool when it has reached the desired location. Fluid is then injected through the pump-down tool into the formation for operations such as cleaning sand out of the wellbore, consolidating sand with plastic, acidizing, fracturing, solvent treating and the like. In the design of such pump-down tools, a certain amount of fluid is normally allowed to bypass the locomotives so that an operating tolerance is achieved to permit movement up and down the first tubing member. When such pump-down tools are used for injection, significant amounts of fluid are lost by reason of the fluids bypassing the locomotives which are in position above the H-member thereby allowing portions of the fluid to pass between the locomotives and the inner diameter of the first tubing member and upwardly through the H-member and second tubing member. This fluid does not enter the formation and results in a lower volume of fluid being actually injected and results in a lower velocity through the washing tool and wasted fluid.

Accordingly, an improvement in the tools used for such pump-down operations has been sought whereby increased fluid velocities and better control of fluids may be achieved.

SUMMARY OF THE INVENTION

It has now been found that such an improvement comprises the positioning of a sealing ring means about the tubular member carrying the locomotives by use of a retaining means for releasably maintaining the sealing ring in an angular position relative to the tubular member until the pump-down tool is in position.

DESCRIPTION OF PREFERRED EMBODIMENTS

In the description of the figures, the same numbers will be used throughout to refer to the same or similar components.

Figure 1:
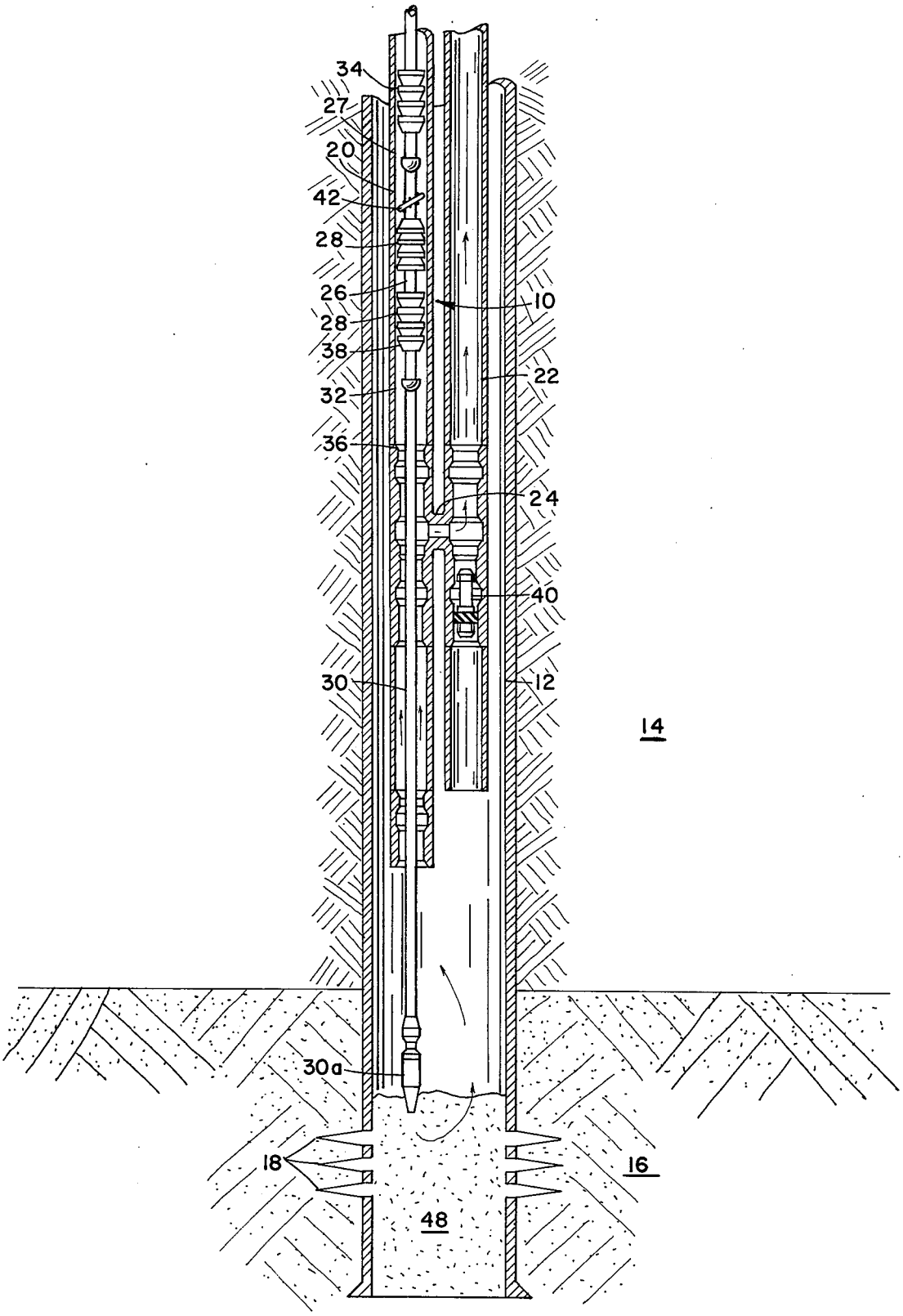
FIG. 1 shows a pump-down tool of a type with which the improvement of the present invention is effective.

In the apparatus shown in FIG. 1, a pump-down tool 10 is shown in position in a cased wellbore 12 which penetrates a subterranean formation 14 and a hydrocarbon-bearing formation 16 which fluidly communicates with wellbore 12 via perforations 18. Wellbore 12 includes a first tubing member 20 and a second tubing member 22 joined near their lower ends by an H-member 24 which provides fluid communication between first tubing member 20 and second tubing member 22. Pump-down tool 10 comprises a tubular member 26 which is equipped with two locomotives 28. Tool 10 is shown in position for fluid injection in FIG. 1 and is equipped with a sand washing nozzle 30 which is joined to tubular member 26 at a rotatable joint 32. A second tubular member 34 including locomotives is shown positioned above tubular member 26 and is totally joined to tubular member 26 by a joint 27. Tool 10 is equipped with a no-go fitting 38 which is adapted to mate with a no-go device 36 positioned on the lower portion of first tubular member 20 to prevent movement of no-go fitting 38 past no-go device 36. Second tubular member 22 is blocked beneath H-member 24 with a plug 40.

In the operation of pump-down tool 10, tool 10 is placed in first tubing member 20 and fluid is pumped down first tubing member 20 through H-member 24 and second tubing member 22 thereby causing tool 10 to move along first tubing member 20 toward H-member 24. Tool 10 is moved in the opposite direction by reversing the pumping sequence and pumping sequentially through second tubing member 22, H-member 24 and first tubing member 20, In the performance of operations such as sand washing as shown in FIG. 1, tool 10 is moved through first tubing member 20 until the tip 30*a* of sand washing nozzle 30 contacts the sand 48 or the like. Fluid is then pumped through first tubing member 20 toward nozzle 30 and a portion of the fluid flows through tubular member 26 and sand washing nozzle 30 thereby washing sand from the portion of wellbore 12 beneath pump-down tool 10. As sand is removed pump-down tool 10 is urged downwardly until no-go fitting 38 mates with no-go device 36 and thereafter injection through sand washing nozzle 30 is continued until the recovered injection fluid is substantially free of sand. The injected fluid flows outwardly through washing nozzle 30, then upwardly through the annular space between the outer diameter of sand washing nozzle 30 and the inner diameter of first tubular member 20, through H-member 24 and upwardly through second tubing member 22. Injection is normally continued until the recovered fluid is clear.

The fluid injection may be water, brine, oil or the like and in many instances is a viscous fluid such as gelled water, brine, oil, water-oil emulsions, oil-water emulsions, foamed water, gas, viscous crude oil, refined oils and the like. Such materials are known to those skilled in the art for use in sand washing operations and need not be discussed further.

Figure 2:
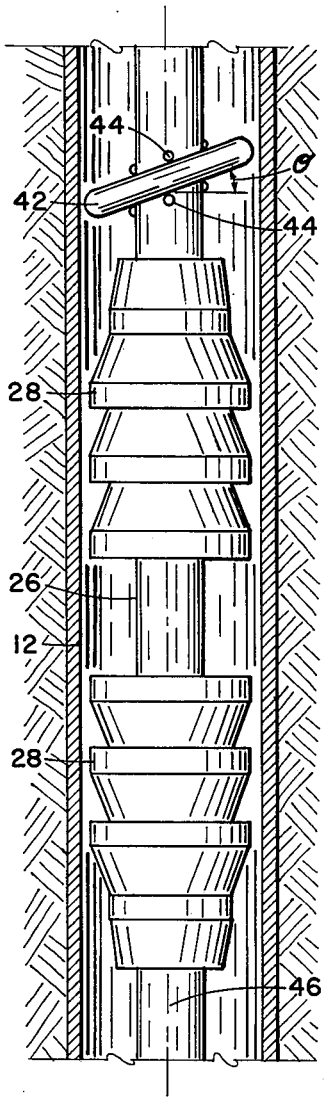
FIG. 2 is a view of a pump-down tool equipped with the improvement of the present invention wherein the sealing ring is releasably maintained in an angular position relative to the tubular member; and, FIG. 3 is a view of the apparatus of FIG. 2 in position for the injection of fluids.

In FIG. 2 the improvement of the present invention is shown in conjunction with the tool of FIG. 1. The improvement comprises a sealing ring 42, releasably positioned by lugs 44 about tubular member 26 so that ring 42 does not contact the inner diameter of first tubing member 20 as tool 10 is pumped through first tubing member 20. Ring 42 is thus not damaged and does not inhibit the movement of fluid into contact with locomotives 28 during the pump-down operation.

In the use of locomotives 28 it is desirable that fluid be allowed to pass between the outer diameter of locomotives 28 and the inner diameter of first tubing member 20. Such subjects each locomotive to a similar pressure so that each locomotive exerts a substantially equal motive force. In the event that a particular locomotive should sealingly contact the inner diameter of first tubing member 20 the effectiveness of the remaining locomotives is decreased to the extent that a complete seal is achieved, since pressure is exerted on only one locomotive surface and a smaller net force is exerted. Thus it is desirable during pump-down operations that no complete seal be formed between the outer diameter of locomotives 28 and the inner diameter of first tubing member 20.

Figure 3:
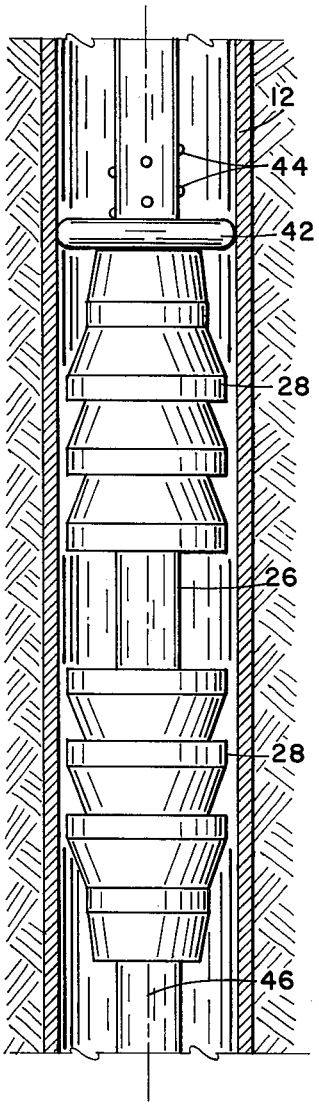

Such is not the case however when tool 10 is positioned for fluid injection. In this instance it becomes desirable that a complete seal be achieved between the outer diameter of tubular member 26 and the inner diameter of first tubing member 20. Such is desirable in order that increased velocities, pressure and volume may be introduced into the portion of well 12 beneath the lower end of first tubing member 20 via sand washing nozzle 30. The passage of fluid past the outer diameter of tubular member 26 and locomotives 28 after tool 10 is in position results in moving sealing ring 42 from its position as releasably maintained by lugs 44 to the position shown in FIG. 3 where it achieves a substantially complete seal between the outer diameter of tubular member 26 and the inner diameter of first tubing member 20. Such allows the use of higher injection velocities, pressure and volume than heretofore when substantial amounts of the injected fluid continued to leak past the outer diameter of locomotives 28.

The use of ring 42 as described above results in a reduction in the amount of treating fluid which is lost through H-member 24 and second tubing member 22, i.e., most of the injected fluid is forced to pass through tool 10 and into the wellbore beneath the lower end of first tubing member 20. Such is highly desirable when operations such as plastic treating and the like are employed.

The use of seal ring 42 does not adversely effect the recovery of tool 10 since the flow past locomotives 28 as tool 10 is moved in a reverse direction through first tubing member 20 tends to dislodge sealing ring 42 from sealing engagement between the outer diameter of tool 10 and the inner diameter of first tubing member 20 and permits flow through second tubing member 22 and H-member 24 to engage locomotives 28 and move tool 10 upwardly through first tubing member 20.

Sealing ring 42 is desirably fabricated of rubber, plastic, metal or the like materials for forming sealing materials as is well known to those skilled in the art. It is particularly preferred that a frangible plastic material be used. Some suitable frangible plastic materials are phenolic, epoxy, urea formaldehyde, rigid polyester, furan and the like resins. Desirably frangible materials are used so that ring 42 is readily broken if it should stick or the like during the recovery of tool 10 from well 12 upon completion of the well treatment or the like. Clearly any resilient material is suitable with the primary requisites being that the material have a resilience such that it is readily released from lugs 44 by the flow of fluid past the outer diameter of second tubular member 26 and such that it results in sealingly contacting tool 10 and the inner diameter of first tubing member 20. The use of such materials is well known to those skilled in the art and need not be discussed further.

Lugs 44 are of any suitable material such as metal, plastic, rubber or the like. The configuration of lugs 44 is such that sealing ring 42 is readily released from lugs 44 when substantial amounts of fluid flow past the outer diameter of tubular member 26. Rounded lugs are considered particularly desirable.

Ring 42 is desirably positioned at an angle $\theta$ of at least 5° from a position perpendicular to the axis 46 of tubular member 26. Larger angles are suitable however at angles greater than about 15° the hole in ring 42 is larger, and tends to allow ring 42 to slip over portions of locomotive 28 and the like. Accordingly it is preferred that the angle be from about 5° to about 15°.

Having thus described certain embodiments of the improvement of the present invention, it is pointed out that many variations and modifications are possible within the scope of the present invention and it is anticipated that many such variations and modifications may be considered obvious and desirable to those skilled in the art upon a review of the foregoing figures and descriptions of preferred embodiments.

Having thus described the invention, I claim:

1. In a pump-down tool for use in well maintenance and treatment operations wherein fluids are injected into or circulated in a well, said tool including a tubular member, having locomotive means positioned thereabout and a fluid passageway positioned therethrough, and a fluid injection means positioned in fluid communication with the lower end of said tubular member as positioned for use; said well having positioned therein a first tubing member and a second tubing member, said first and second tubing members being in fluid communication at a junction near their lower ends, so that when placed in said first tubing member said tool is urged along the length of said first tubing member toward said junction by pumping fluid sequentially through said first tubing member, said junction and said second tubing member and is urged along the length of said first tubing member toward the upper end of said first tubing member by pumping fluid in the opposite direction, the improvement comprising: a sealing ring means positioned around said tubular member, and positioning means on said tubular member for releasably maintaining said sealing ring in position at an angle of at least about 5° from a position perpendicular to the axis of said tubular member.

2. The improvement of claim 1 wherein said sealing ring is positioned above said locomotive means as positioned for use.

3. The improvement of claim 1 wherein said positioning means comprises a plurality of lugs positioned on the outer diameter of said tubular member.

4. The improvement of claim 1 wherein said sealing ring comprises at least one material selected from the group consisting of rubber, plastic and metal.

5. The improvement of claim 4 wherein said seal ring comprises a frangible plastic.

* * * * *